US006843697B2

(12) United States Patent
Rasmussen

(10) Patent No.: US 6,843,697 B2
(45) Date of Patent: Jan. 18, 2005

(54) BLACK MATRIX FOR FLAT PANEL FIELD EMISSION DISPLAYS

(75) Inventor: Robert T. Rasmussen, Boise, ID (US)

(73) Assignee: Micron Display Technology, Inc., Boise, ID (US)

( * ) Notice: Subject to any disclaimer, the term of this patent is extended or adjusted under 35 U.S.C. 154(b) by 0 days.

(21) Appl. No.: 10/339,409

(22) Filed: Jan. 10, 2003

(65) Prior Publication Data

US 2004/0027050 A1 Feb. 12, 2004

Related U.S. Application Data

(62) Division of application No. 09/339,958, filed on Jun. 25, 1999.

(51) Int. Cl.[7] ..... H01J 9/00
(52) U.S. Cl. ..... 445/24; 445/25
(58) Field of Search ..... 445/24, 25

(56) References Cited

U.S. PATENT DOCUMENTS

| | | | | |
|---|---|---|---|---|
| 4,891,110 A | | 1/1990 | Libman et al. | 204/478 |
| 5,445,899 A | * | 8/1995 | Budzilek et al. | 428/690 |
| 5,534,749 A | * | 7/1996 | Ohoshi et al. | 313/497 |
| 5,576,595 A | | 11/1996 | Curtin et al. | 313/422 |
| 5,576,596 A | | 11/1996 | Curtin et al. | |
| 5,578,899 A | | 11/1996 | Haven et al. | 313/422 |
| 5,650,690 A | | 7/1997 | Haven | 313/422 |
| 5,668,437 A | * | 9/1997 | Chadha et al. | 313/495 |
| 5,759,446 A | | 6/1998 | Chadha et al. | 448/24 |
| 5,762,773 A | | 6/1998 | Rasmussen | |
| 5,776,540 A | | 7/1998 | Chadha et al. | |
| 5,952,771 A | | 9/1999 | Zhang | 313/309 |
| 5,982,082 A | | 11/1999 | Janning | 313/336 |
| 6,054,808 A | | 4/2000 | Watkins et al. | 313/495 |
| 6,068,750 A | | 5/2000 | Rasmussen | 204/490 |
| 6,255,772 B1 | | 7/2001 | Cathey et al. | 313/495 |

OTHER PUBLICATIONS

C. Curtin, "The Field Emission Display: A New Flat Panel Technology," Conference Record of the 1991 International Display Research Conference. SID. San Diego. USA. 1991, Cover, pp. iii–vii and pp. 12–15.

* cited by examiner

*Primary Examiner*—Nimeshkumar D. Patel
*Assistant Examiner*—Mariceli Santiago
(74) *Attorney, Agent, or Firm*—Nixon & Vanderhye P.C.

(57) ABSTRACT

A flat panel field emission device includes a black matrix formed from an electrically insulative material such as praseodymium-manganese oxide. The insulative black matrix increases image contrast and reduces power consumption. For field emission devices which utilize a switched anode for selectively activating pixels, the insulative material reduces or eliminates problems associated with short circuiting of the pixels.

10 Claims, 5 Drawing Sheets

BLACK MATRIX FOR FLAT PANEL FIELD EMISSION DISPLAYS

This application is a divisional of application Ser. No. 09/339,958, filed Jun. 25, 1999.

STATEMENT OF GOVERNMENT INTEREST

This invention was made with Government support under Contract No. DABT63-93-C-0025 awarded by Advanced Research Projects Agency (ARPA). The Government has certain rights in this invention.

BACKGROUND OF THE INVENTION

The present invention relates to an improved flat panel display. More particularly, the present invention relates to an improved flat panel display such as a field emission display and a black matrix which improves image quality of the flat panel display.

Cathode ray tube (CRT) displays, such as those commonly used in desk-top computer screens, function as a result of a scanning electron beam from an electron gun impinging on phosphors of a relatively distance screen. The electrons increase the energy level of dopant(s) in the phosphors. When the dopant(s) return to their normal energy level, they release energy from the electrons as photons of light, which is transmitted through the glass screen of the display to the viewer.

One major disadvantage with CRT displays is that the CRT screen must be spaced from the electron gun by a relatively long distance. Moreover, CRTs typically consume relatively large amounts of power in operation. Thus, a CRT is not suited for use in small, portable devices—particularly those which operate under battery power.

Flat panel display technology is becoming increasingly important in appliances requiring lightweight portable screens. Currently, such screens typically use electroluminescent, liquid crystal, or plasma display technologies. Field emission devices represent a promising flat panel display technology which utilizes an array of cold cathodes or field emitter tips to excite pixels of phosphors on a screen. As an example, a field emission display may utilize a matrix-addressable array of cold cathodes which is selectively operated to activate particular picture segments. Field emission displays seek to combine the advantages of cathodoluminescent-phosphor technology with integrated circuit technology to create thin, high resolution displays wherein each pixel is activated by its own electron emitter.

Field emission devices generally include a baseplate assembly and an opposed faceplate. The faceplate has a cathodoluminescent phosphor coating that receives a patterned electron bombardment from the opposing baseplate, thereby providing a light image which can be seen by a viewer. The faceplate is separated from the baseplate by a vacuum gap, and outside atmospheric pressure is prevented from collapsing the two plates together by support columns. These support columns are often referred to as spacers. Arrays of electron emission sites (emitters) typically include a plurality of sharp cones that produce electron emission in the presence of an intense electric field. In the case of most field emission displays, a positive voltage is applied to an extraction grid relative to the sharp emitters to provide the intense electric field required for generating cold cathode electron emissions. Typically, FEDs are operated at anode voltages well below those of conventional CRTs.

The faceplate of a field emission display operates on the principle of cathodoluminescent emission of light. A color image can be obtained using a color sequential approach sometimes referred to as spatial integration. Nearly all commercially successful color displays today employ spatial integration to provide a color image to the viewer. A common way to employ spatial integration is to provide red, green, and blue pixels which are addressed in the form of R/G/B triads. The intensity of each of the color dots within the triad is adjusted relative to one another to produce a range of colors within the triangular boundary formed by the color coordinates of the R, G, and B dots as depicted on the 1931 or 1976 C.I.E. chromaticity diagram. During viewing, the human eye integrates the spatially separated R/G/B dots into a perceived color image.

Spatial color displays may include a dark region separating the red, green, and blue patterned dots. For optimal performance, this region should be black. A major advantage of this region, referred to as the black matrix (although not necessarily black), is improved contrast of the display in ambient light. When a black matrix is employed on the faceplate it absorbs ambient incident light, thereby improving the contrast performance of the display. The use of a black matrix or "grille" in a CRT is described, for example, in U.S. Pat. No. 4,891,110, issued Jan. 2, 1990 to Libman et al., which is hereby incorporated by reference in its entirety.

As noted above, display technology such as CRTs consume relatively large amounts of energy. However, applications such as portable battery-operated computer displays put a premium on lower power consumption. Displays for other portable devices, such as portable stereos, electronic diaries, electronic telephone directories, and the like, also require low power consumption. Moreover, with available software features and consumer preferences, it is also desirable to provide portable devices with the ability to display color images.

Accordingly, there is a need for a flat panel color display having good contrast and reduced power consumption. Since flat panel field emission displays will become important in portable appliances that rely on portable power sources, there is a need to minimize the power consumption required by such displays. The present invention provides a field emission device which can provide color images having good contrast in a display having reduced power consumption.

BRIEF SUMMARY OF THE INVENTION

In accordance with one aspect of the present invention, a black matrix for a flat panel cathodoluminescent display, such as a field emission device, is formed from a substantially insulative material. An exemplary embodiment of the present invention includes a screen having a phosphor coating and an opposed emission source which selectively excites portions of the phosphor coating to generate visible light. The opposed emission source may include, for example, an array of conical field emitter cathodes. The black matrix may be formed, for example, from praseodymium-manganese oxide ($PrMnO_3$).

A flat panel field emission device in accordance with the present invention may include a faceplate having a screen with phosphors and an insulative black matrix provided thereon. A baseplate includes a plurality of electron emission cathode tips arranged in an array and a lower potential extraction grid. The electron emission cathode tips may be selectively operated with row and column control signals to excite particular portions of the phosphors on the screen. Alternatively, the cathode tips may be addressed by row control signals, and columns in the extraction grid may be selected by column control signals to excite the particular portions of the screen phosphors. Additionally, the screen may include an addressable matrix of anode electrodes which are operated with row and column control signals.

BRIEF DESCRIPTION OF THE DRAWINGS

The objects, features, advantages and characteristics of the present invention will become apparent from the following detailed description of an exemplary embodiment, when read in view of the accompanying drawings, wherein.

DETAILED DESCRIPTION OF EXEMPLARY EMBODIMENTS

The present invention is described in the context of exemplary embodiments. However, the scope of the invention is not limited to the particular examples described in the specification. Rather, the description merely reflects what are currently considered to be the most practical and preferred embodiments, and serves to illustrate the principles and characteristics of the present invention. Those skilled in the art will recognize that various modifications and refinements may be made without departing from the spirit and scope of the invention.

Figure 1A:
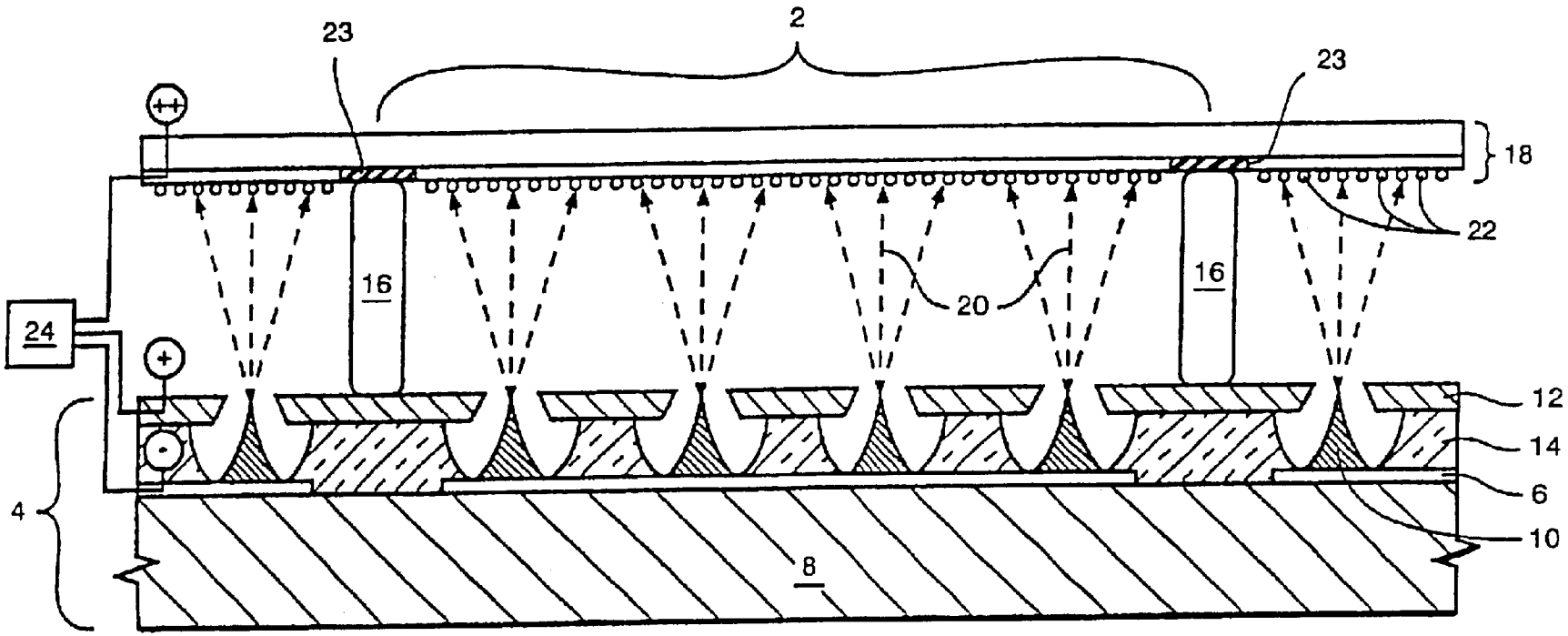
FIG. 1A is an illustrative cross-sectional schematic drawing of a flat panel field emission display.

FIG. 1A is a cross-sectional schematic of a portion of a flat panel field emission display. In particular, a single display segment 2 is depicted. Each display segment is capable of displaying, for example, a pixel of information or a portion of a pixel. A field emission display base assembly 4 includes a patterned conductive material layer 6 provided on a base 8 such as a soda lime glass substrate. The conductive material layer 6 may be formed, for example, from doped polycrystalline silicon and/or an appropriate conductive metal such as chromium. The conductive material layer 6 forms base electrodes and conductors for the field emission device.

Conical micro-cathode field emitter tips 10 are constructed over the base 8 at the field emission cathode site. A base electrode resistive layer (not shown) may be provided between the conductive material layer 6 and the field emitter tips 10. The resistive layer may be formed, for example, from silicon which has been doped to provide an appropriate degree of resistance. The resistive layer may operate as a lateral resistor wherein the direction of current flow from the base conductor 6 to the emitter tips 10 is primarily lateral. This arrangement helps reduce the likelihood of pinhole shorts through the resistive layer. Alternatively, a vertical resistor could be provided, in which case the field emitter tips 10 would be vertically aligned over the base conductor 6, and current flow would be primarily vertical.

A low potential anode gate structure or extraction grid 12 formed, for example, of doped polycrystalline silicon is arranged adjacent the field emitters 10. An insulating layer 14 separates the extraction grid 12 from the base electrode conductive material layer 6. The insulating layer 14 may be formed, for example, from silicon dioxide.

Proper functioning of the emitter tips requires operation in a vacuum. Thus, a plurality of support columns 16 are provided over the base assembly 4 to support a display screen 18 against atmospheric pressure. The support columns 16 are commonly referred to as "spacers." The spacers 16 may be formed in a number of conventional ways. Appropriate techniques for forming the spacers 16 are disclosed, for example, in U.S. Pat. No. 5,205,770 issued Apr. 27, 1993 to Lowrey et al., U.S. Pat. No. 5,232,549 issued Aug. 3, 1993 to Cathey at al., U.S. Pat. No. 5,484,314 issued Jan. 16, 1996 to Farnworth, and U.S. Pat. No. 5,486,126 issued Jan. 23, 1996. Each of these patents is hereby incorporated by reference in its entirety.

In operation, the display screen 18 acts as an anode so that field emissions from the emitter tips 10, represented by arrows 20, strike phosphor coating 22 on the screen 18. A black matrix 23 is formed on the screen 18 to improve image contrast. The field emissions from the emitter tips 10 excite the phosphor coatings 22 to generate light. A field emission is produced from an emitter tip when a voltage controller 24 establishes a voltage differential between the emitter tip and the anode structures. Thus when a group of emitter tips is activated, electrons are accelerated toward the phosphor coated transparent plate of the screen, which serves as an anode and has a positive voltage relative to the activated emitters. The phosphor on the screen is induced into cathodoluminescence by the bombarding electrons arriving at the phosphor surface, and serves as the emissive light source seen by a viewer.

A large number of suitable phosphors are known in the art. However, not all phosphors are recommended for use in field emission devices because the cathodes are in relatively close proximity to the coatings and may be sensitive to electronegative chemicals arriving on the cold cathode emitter surfaces. These surfaces can absorb the chemicals, thereby increasing the work function value and requiring higher operating voltages. This is undesirable in portable devices. Accordingly, the most preferred phosphors for use in a field emission device include, for example, ZnO:Zn, $Y_3(Al, Ga)_5O_{12}$:Tb, $Y_2SiO_5$:Ce, $Y_2O_3$:Eu, $Zn_2SiO_4$:Mn, $ZnGa_2O_4$ and $ZnGa_2O_4$:Mn. Except for ZnO:Zn and $ZnGa_2O_4$, these phosphors tend to be dielectric in nature. As a consequence, the typical threshold voltage needed to excite the phosphor tends to be relatively high (e.g., approximately 500 V to 2000 V). However, the threshold voltage may be reduced in a known manner by adding conducting materials such as non-luminescent zinc oxide or indium tin oxide powders to the phosphors before application to the screen.

It has been found that during operation a charge builds up on phosphors which are nonconductive or semi-conductive. The incident electrons on the phosphors surface are reflected, scattered, or absorbed by the phosphor. Furthermore, if the energy of these incident electrons is greater than a few tens of eV, then they can create a large number of secondary electrons within the phosphor screen. Some of these secondary electrons can escape back into the vacuum provided they have sufficient energy to overcome the work function of the phosphor surface. This can lead to the floating surface of the phosphor to shift its potential when the number of incident electrons is not equal to the number of secondary electrons escaping from the surface. The negative charge built up on the phosphor screen, by reducing its potential, seriously diminishes the light output, leading to an unstable emission. Thus, it is desirable to have some degree of conductivity in the phosphors.

Figure 1B:
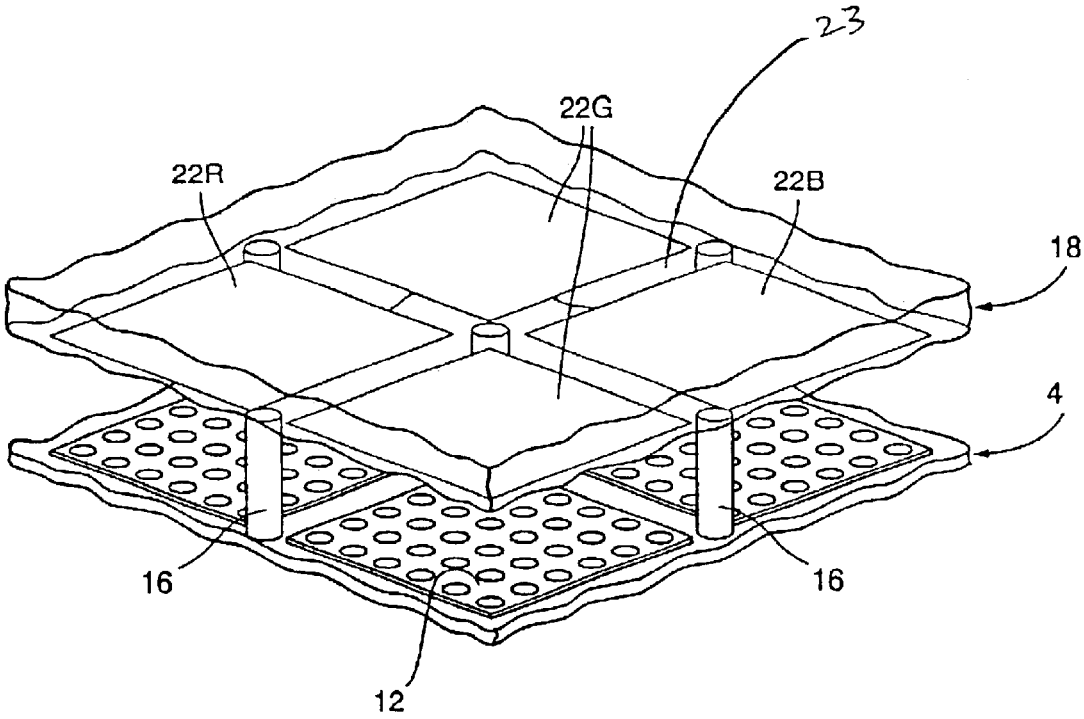
FIG. 1B is an illustrative perspective view of the flat panel field emission display of FIG. 1A.

Referring now to the perspective view of FIG. 1B, the phosphor coating may provide a number of segments useful in presenting a color image using an R/G/B diode. In particular, the phosphors may be arranged to provide a red picture segment 22R, a green picture segment 22G, and blue picture segment 22B which form a triangular layout. The black matrix 23 preferably forms a grid-like structure which separates the individual color picture segments. It is not necessary that the color segments be in the particular arrangement illustrated in FIG. 1B. For example, the individual color segments could be arranged in common rows or columns (e.g., a row of green phosphors arranged between a row of red phosphors and a row of blue phosphors). Such an alternative arrangement may be advantageous, for example, in a field emission device which employs a switched anode scheme.

Various techniques are known in the art for allowing selectable activation of a display segment. For example, the grid 12 and screen 18 illustrated in FIGS. 1A and 1B could be held at a constant voltage potential and emitter tips selectively switched through column and row signals. In such an arrangement, the patterned conductive material 6 which forms the cathode base electrodes is arranged as a matrix that is addressable through column and row control signals. Alternatively, the base electrode conductors could be arranged in rows and the grid 12 arranged in columns perpendicular to the rows of cathode base electrodes. Row control address signals to the cathode base electrodes and column control address signals to the grid column segments selectably activate display segments. Finally, the cathodes could be held at a constant voltage potential and a switched anode scheme utilized for the display screen 18. In a switched anode scheme, the faceplate conductor may include an addressable matrix of electrodes corresponding to individual picture segments.

Figure 2:
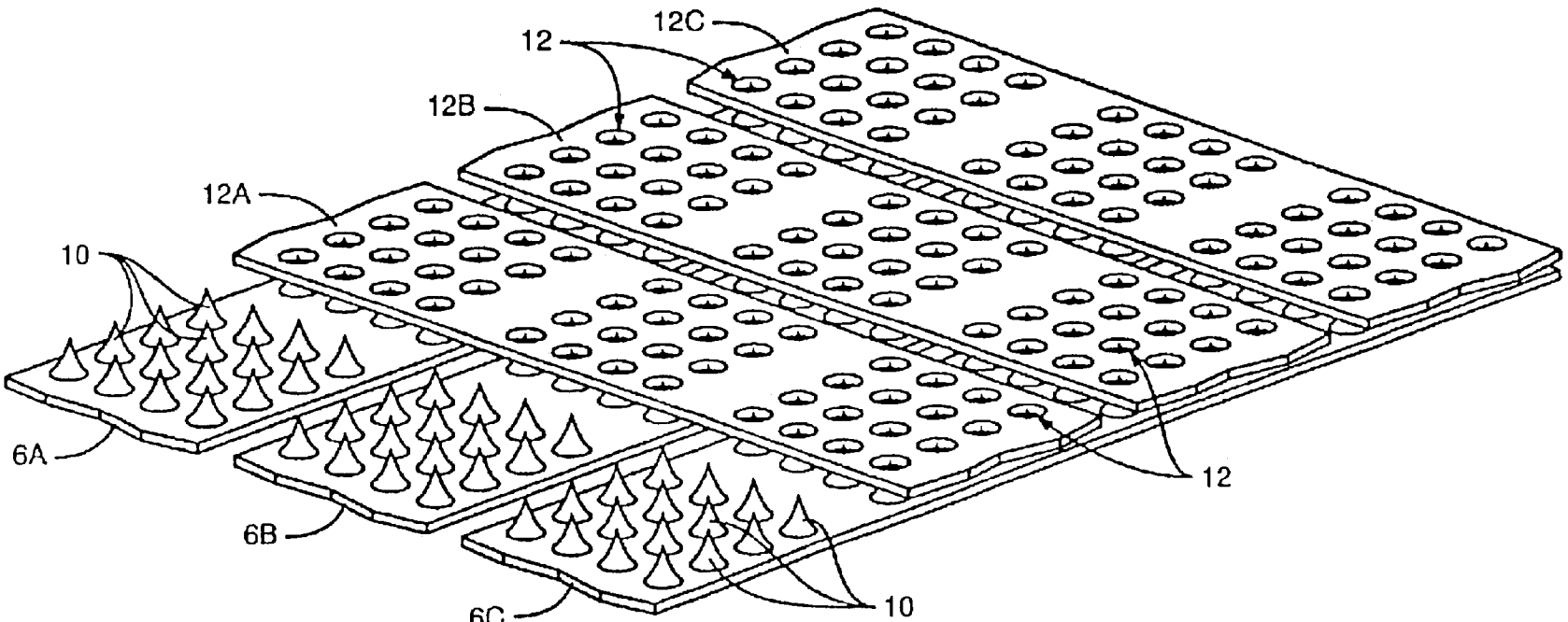
FIG. 2 is a simplified perspective view of a conventional grid and emitter base electrode structure in a flat panel field emission display.

Turning now to FIG. 2, in one example the conductive material layer 6 may include a series of rows 6A, 6B and 6C, and the grid electrode 12 may include a series of columns 12A, 12B and 12C. It should be appreciated that FIG. 2 is merely illustrative and, in practice, many more rows and columns would typically be provided for a display screen. Each picture segment in this example includes a 4×4 group of micro-cathode emitter tips 10. The redundancy in cathodes improves picture resolution and enhances product reliability and manufacturing yield.

To drive a particular picture segment, the controller selects a conductive material layer row (row 6C for example) and a grid electrode column (column 12A for example) and connects them respectively to appropriate voltage potentials. In this way, the picture segment corresponding to the cathodes located at the intersection of row 6C and column 12*a* will be activated. Suitable pixelator drive circuitry for the rows and columns is known in the art and is disclosed, for example, in commonly-owned U.S. Pat. No. 5,438,240, issued Aug. 1, 1995 to Cathey et al., and U.S. Pat. No. 5,410,218, issued Apr. 25, 1995 to Hush, which are hereby incorporated by reference in their entirety.

As previously noted, in a different arrangement the conductive material 6 which forms the base electrodes may form a matrix of addressable nodes and provide for both row and column controls for addressing the field emitters. In such an arrangement, the patterned conductive material layer 6 preferably provides a matrix of base electrodes under the individual picture segments. The conductive grid 12 is preferably continuous throughout the entire display and is maintained at a constant potential $V_{GRID}$. Drive circuits for use with such an arrangement are disclosed, for example, in commonly-owned U.S. Pat. No. 5,357,172, issued Oct. 18, 1994 to Lee et al, U.S. Pat. No. 5,387,844, issued Feb. 7, 1995 to Browning, and U.S. Pat. No. 5,459,480, issued Oct. 17, 1995, to Browning et al. These patents are hereby incorporated by reference in their entirety.

Figure 3A:
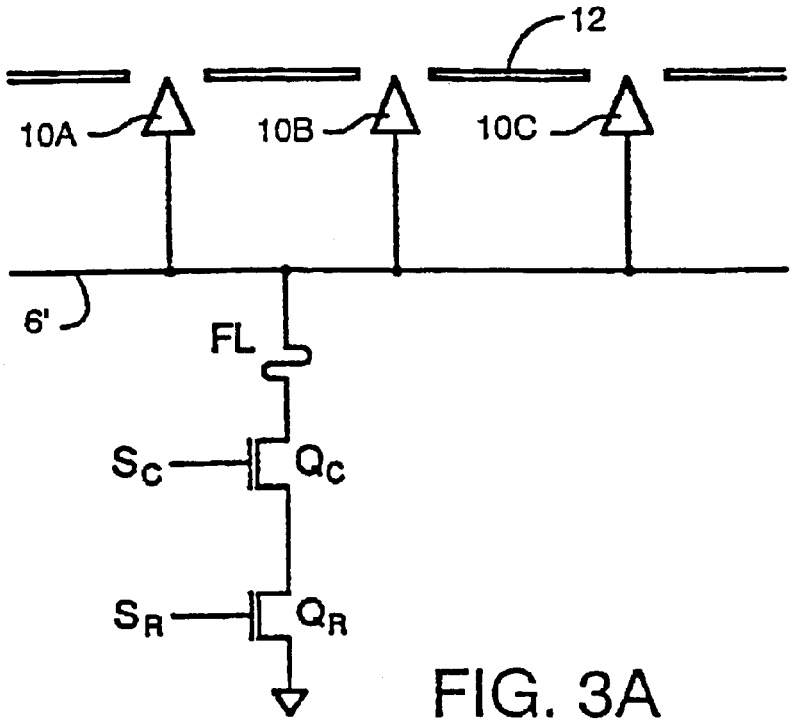
FIG. 3A illustrates a drive circuit for a flat panel field emission display which utilizes an alternative grid and emitter base electrode structure.

A single emitter node is illustrated in FIG. 3A. Although the example emitter node depicted by FIG. 2 has only three field emitter tips (10A, 10B, 10C), the actual number may be much higher. Each of the emitter tips 10 is electrically coupled to a base electrode 6' that is common to only the emitters of a single emitter node. To induce field emission, base electrode 6' may be operated in a pull-down node. In the preferred embodiment, the base electrode 6' is maintained at ground potential through a pair of series-coupled field-effect transistors $Q_C$ and $Q_R$. Transistor $Q_C$ is gated by a column line control signal $S_C$ from controller 24, while transistor $Q_R$ is gated by a row line control signal $S_R$. When one of the transistors $Q_C$ and $Q_R$ is switched OFF, electrons continue to be discharged form the corresponding emitter tips until the voltage differential between the base electrode 6' and the grid 12 drops below the emission threshold voltage. At that point, the display segment is turned OFF.

Figure 3B:
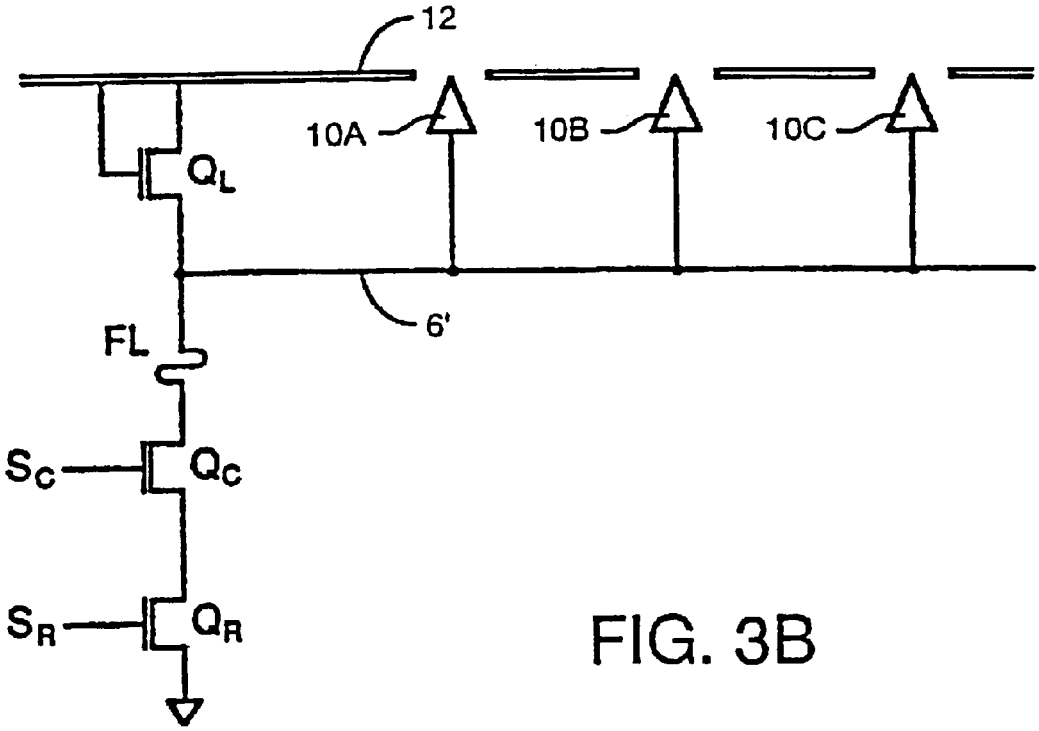
FIG. 3B illustrates a modification of the drive circuit of FIG. 3A.

FIG. 3B illustrates a modification of the arrangement of FIG. 3A, wherein a current limiting field effect transistor $Q_L$ having a threshold voltage $V_T$ has been added. Both the drain and gate of transistor $Q_L$ are directly coupled to grid 12. The channel transistor $Q_L$ is sized such that current is limited to a minimal amplitude necessary to restore base electrode 6' and associated emitters 10A, 10B and 10C, to a potential that is substantially equal to $V_{GRID}-V_T$ at a rate sufficient to ensure adequate gray scale resolution.

A fusible link FL may be provided in the arrangements of FIGS. 3A and 3B. The fusible link FL may be blown during testing if a base-to-emitter short is detected within that emitter group, thus isolating the shorted group from the remainder of the array to improve yields and to minimize array power consumption.

Figure 3C:
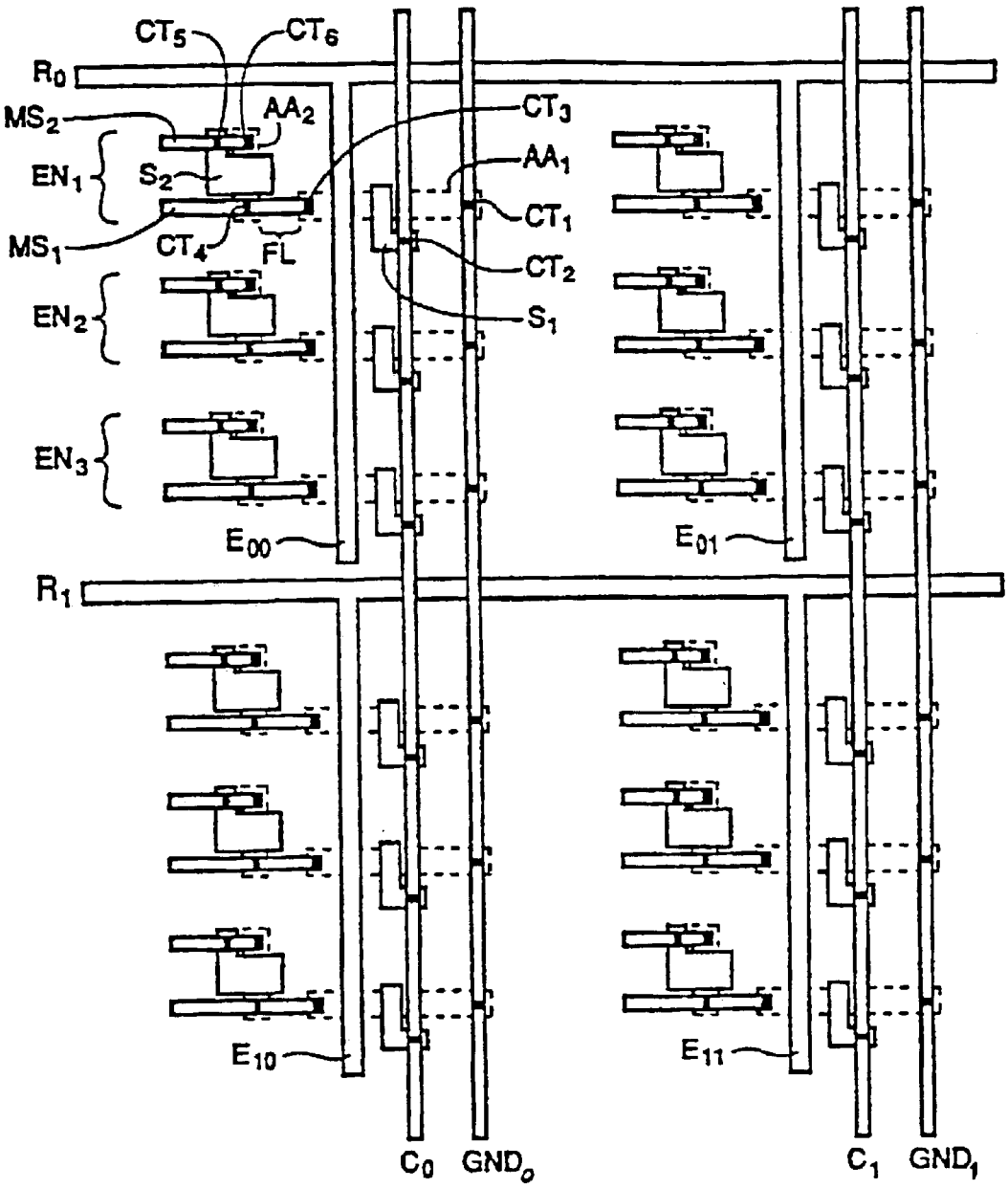
FIG. 3C is a top plan view of a layout for a flat panel field emission display architecture in which the drive circuits of FIGS. 3A or 3B may be used.

Referring now to FIG. 3C, a simplified layout is depicted which provides for multiple emitter nodes for each row-column intersection of the display array. The conductive material layer 6 includes a pair of doped polycrystalline silicon row lines $R_0$ and $R_1$ which orthogonally intersect metal column lines $C_0$ and $C_1$ and a pair of metal ground lines $GND_0$ and $GND_1$. Ground line $GND_0$ is associated with column line $C_0$, while ground line $GND_1$ is associated with column line $C_1$. For each row and column intersection, there is at least one row line extension, which forms the gates and gate interconnects for multiple emitter nodes within that pixel. For example, extension $E_{00}$ is associated with the intersection of row $R_0$ and column $C_0$; extension $E_{01}$ is associated with the intersection of row $R_0$ and column $C_1$; extension $E_{10}$ is associated with the intersection of row $R_1$ and column $C_0$; and extension $E_{11}$ is associated with the intersection of row $R_1$ and column $C_1$. As all intersections function in an identical manner, only the components with the $R_0$–$C_0$ intersection region will be described in detail.

Three emitter nodes, $EN_1$, $EN_2$ and $EN_3$, are supported by the $R_0$–$C_0$ intersection region. Each emitter node comprises a first active area $AA_1$ and a second active area $AA_2$. A metal ground line GND makes contact to one end of first active area $A_1$ at first contact $CT_1$ . In combination with first active area $AA_1$, a first L-shaped doped polycrystalline silicon strip S1 forms the gate of field-effect transistor $Q_C$ (see FIGS. 3A and 3B). Metal column line $C_0$ makes contact to doped polycrystalline silicon strip $G_1$ at second contact $CT_2$. Doped polycrystalline silicon extension $E_{00}$ forms the gate of field-effect transistor $Q_R$ (see FIGS. 3A and 3B). A first metal strip $MS_1$ interconnects first active area $AA_1$ and second active area $AA_2$, making contact at third contact $CT_3$ and fourth contact $CT_4$, respectively. The portion of metal strip $MS_1$ between third contact $CT_3$ and fourth contact $CT_4$ forms fusible link FL. The emitter base electrode 6' (not shown in FIG. 3C, see item 6' in FIGS. 3A and 3B) is coupled to metal strip $MS_1$. A second L-shaped doped polycrystalline silicon strip $S_2$ forms the gate of current limiting transistor $Q_{CL}$, and a second metal strip $MS_2$ is connected to second doped polycrystalline silicon strip $S_2$ at fifth contact $CT_5$, and to second active area $AA_2$ at sixth contact $CT_6$. The grid plate (not shown in FIG. 3C, see FIGS. 3A and 3B) is connected to second metal strip $MS_2$. Of course, other conductive materials may be substituted for the doped polycrystalline silicon and metal structures. For example, silicided polysilicon or molybdenum may be used.

Various techniques are known for producing structures such as those illustrated in FIGS. 1–3. For example, techniques for forming the conical cathode emitter tips are disclosed in commonly-owned U.S. Pat. No. 5,151,061, issued Sep. 29, 1992 to Sandhu, U.S. Pat. No. 5,330,879, issued Jul. 19, 1994 to Dennison, U.S. Pat. No. 5,358,908, issued Oct. 25, 1949 to Reinberg et al., U.S. Pat. No. 5,391,259, issued Feb. 21, 1995 to Cathey et al., and U.S. Pat. No. 5,438,259 issued Aug. 1, 1995 to Cathey et al. Each of these patents is hereby incorporated by reference. In addition to the foregoing techniques, conventional methods such as the Spindt process for producing conical field emitters are well-known in the art. Processes for producing field emitters are disclosed, for example, in Spindt et al. U.S. Pat. No. 3,665,241, issued May 23, 1972, U.S. Pat. No. 3,755,704, issued Aug. 28, 1973, and U.S. Pat. No. 3,812,559, issued May 28, 1974.

Overall techniques for producing the base assembly are known, for example, from U.S. Pat. No. 5,186,670, issued Feb. 16, 1993 to Doan et al. and U.S. Pat. No. 5,372,973, issued Dec. 13, 1994 to Doan et al. The techniques disclosed in those patents utilize a mechanical planarization technique such as chemical-mechanical planarization following creation of the layers which make up the base assembly. Each of these patents is hereby incorporated by reference in its entirety.

In a preferred exemplary embodiment, the black matrix is formed from praseodymium-manganese oxide ($PrMnO_3$) having an appropriately high molar ratio of praseodymium to manganese (Pr:Mn). The molar ratio is selected to ensure that the black matrix material is highly resistive. This can be accomplished by reducing the amount of manganese relative to praseodymium, thereby decreasing conductivity. The praseodymium-manganese oxide material may be made by combining $Pr_6O_{11}$ with $MnO_2$ or $MnCO_3$ in a mill jar and milling the combination to a powder containing particles having an average diameter of approximately 2 $\mu$m. The powder may then be heated at a temperature ranging from 1200° C. to 1500° C., and preferably from 1250° C. to 1430° C., for about 4 hours. As a result, the material takes on a very dark matte black color. The powder is thereafter re-crushed and milled to yield a powder having about a 2 $\mu$m average particle size. The Pr:Mn ratio in the resulting material may be controlled by adjusting the relative amounts of $Pr_6O_{11}$ and $MnO_2$ or $MnCO_3$ in the starting materials.

The praseodymium-manganese oxide material may be deposited on the screen using conventional techniques well-known in the art. For example, RF sputtering, laser ablation, plasma deposition, chemical vapor, deposition or electron beam evaporation maybe utilized. Appropriate operating parameters used in the foregoing techniques are readily within the skill in the art, and need not be detailed here.

Prior to deposit of the black matrix material, the screen may be patterned with a photoresist in a known manner to expose only those areas of the screen on which the black matrix is to be deposited. The photoresist may then be removed following deposition of the black matrix material. A second photoresist may then be patterned to expose only those areas of the screen on which the phosphor is to be deposited, followed by depositing phosphor in the exposed areas. If desired, an appropriate binder may be applied and the screen baked, as is known in the art.

As an alternative, a uniform layer of $PrMnO_3$ may be provided on the screen. An appropriate etching technique may than be utilized to remove portions of the $PrMnO_3$ layer that do not correspond to the black matrix, as understood in the art. Of course, other appropriate techniques known in the art may be utilized as well.

As noted above, the praseodymium-manganese oxide material used in the black matrix is selected to be highly resistive, and therefore acts as an insulator. For low voltage operations, it is beneficial to have the areas around the pixels be insulated so that electrons go to the phosphors rather than being drained by non-light emissive materials of the black matrix. Such a drain wastes emitted electrons and increases power consumption, which would be a notable drawback for battery operated devices in particular. Furthermore, if a screen anode switching scheme is utilized to selectively activate the pixels, as discussed above, an insulative black matrix material alleviates possible problems associated with electrical shorting between the pixels. Such short circuits, of course, degrade or completely ruin the quality of any displayed image.

Although the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims. For example, appropriate insulative materials other than praseodymium-manganese oxide also may be used for the black matrix 23.

What is claimed is:

1. A method of making a flat panel field emission display comprising the steps of:

providing a phosphor coating on a display screen;

arranging an emission source opposite said display screen for selectively exciting portions of said phosphor coating to generate visible light during subsequent operation; and providing a black matrix on said screen, said black matrix being formed from praseodymium-manganese oxide;

wherein said black matrix forming step includes patterning a photoresist material on said screen to expose only those areas of the screen on which the black matrix is to be deposited; depositing said praseodymium-manganese oxide; and removing said photoresist material; and said step of providing a phosphor coating is performed subsequent to said black matrix forming step and includes patterning a second photoresist material to expose only those areas of the screen on which said phosphor coating is to be provided; depositing said phosphor coating; and removing said second photoresist material.

2. The method of claim 1 wherein said praseodymium-manganese oxide has a high resistance such that the black matrix does not drain electrons from the emission source.

3. The method of claim 1, wherein said emission source arranging step arranges an array of field emitter tip cathodes opposite said display screen.

4. The method of claim 3, including the further step of providing a low potential extraction grid adjacent to said field emitter tip cathodes.

5. The method of claim 4, wherein said low potential extraction grid is formed from a continuous electrode.

6. The method of claim 1, wherein said praseodymium-manganese oxide is prepared by combining selected amounts of $Pr_6O_{11}$ with a material selected from the group including $MnO_2$ and $MnCO_3$; and heating the resulting combination at a temperature ranging from approximately 1200° C. to 1500° C.

7. The method of claim 6, wherein the resulting combination is heated for approximately four hours at the heating temperature.

8. The method of claim 6, including the further step of milling the resulting combination subsequent to said heating step to yield a powder having about a 2 $\mu$m average particle size.

9. The method of claim 6, wherein said heating temperature ranges approximately from 1250° C. to 1430° C.

10. The method of claim 9, wherein the resulting combination is heated for approximately four hours at the heating temperature.

* * * * *